US006942736B2

(12) United States Patent
Chinander et al.

(10) Patent No.: US 6,942,736 B2
(45) Date of Patent: Sep. 13, 2005

(54) AUTOMATICALLY CONTROLLED FLOW APPLICATOR

(75) Inventors: Michael Chinander, 1195 18th St. SE., Owatonna, MN (US) 55060; Bruce Bean, 5200 Wilson Rd., Minneapolis, MN (US) 55424

(73) Assignees: Michael Chinander, Owatonna, MN (US); Bruce Bean, Minneapolis, MN (US)

( * ) Notice: Subject to any disclaimer, the term of this patent is extended or adjusted under 35 U.S.C. 154(b) by 13 days.

(21) Appl. No.: 10/647,793

(22) Filed: Aug. 25, 2003

(65) Prior Publication Data

US 2005/0048206 A1 Mar. 3, 2005

(51) Int. Cl.[7] ..... B05C 11/00; B67D 5/08

(52) U.S. Cl. ..... 118/692; 118/674; 118/697; 222/54; 222/55

(58) Field of Search ..... 118/692, 697, 118/699, 674; 222/54, 55

(56) References Cited

U.S. PATENT DOCUMENTS

| | | | | |
|---|---|---|---|---|
| 4,829,793 A | | 5/1989 | Holder et al. | 68/205 R |
| 4,842,162 A | | 6/1989 | Merkel | 222/1 |
| 4,922,852 A | | 5/1990 | Price | 118/683 |
| 4,988,015 A | | 1/1991 | Price | 222/1 |
| 5,065,695 A | | 11/1991 | Baron et al. | 118/688 |
| 5,263,608 A | | 11/1993 | Kiernan et al. | 222/1 |
| 5,319,568 A | | 6/1994 | Bezaire | 700/123 |
| 5,327,423 A | | 7/1994 | Audouin et al. | 370/489 |
| 5,348,585 A | * | 9/1994 | Weston | 118/305 |
| 5,462,199 A | * | 10/1995 | Lenhardt | 222/54 |
| 5,857,589 A | | 1/1999 | Cline et al. | 222/1 |
| 5,995,909 A | | 11/1999 | Bretmersky et al. | 702/50 |

* cited by examiner

*Primary Examiner*—Chris Fiorilla
*Assistant Examiner*—Yewebdar Tadesse
(74) *Attorney, Agent, or Firm*—Mark A. Litman and Associates, P.A.

(57) ABSTRACT

A system allows for accurate manual application of a fluid material in a linear pattern to a surface from a container holding the fluid. The system may comprise a container holding a fluid, the container having an application end from which fluid is applied to the surface at a volume flow rate that provides a volume/linear distance of the linear pattern. There is a controllable pressure system that causes pressure in the container, wherein application of higher pressure causes increased flow of fluid from the container and reduction of pressure causes reduced flow of fluid from the container. Also present is a speed indicator that provides a signal of the relative speed between the application end and the surface. A microprocessor reads the signal and determines if the controllable pressure is at a predetermined target level with respect to the relative speed, the microprocessor adjusting the controllable pressure system to attempt to maintain a standard volume of liquid per linear distance of the linear pattern.

15 Claims, 1 Drawing Sheet

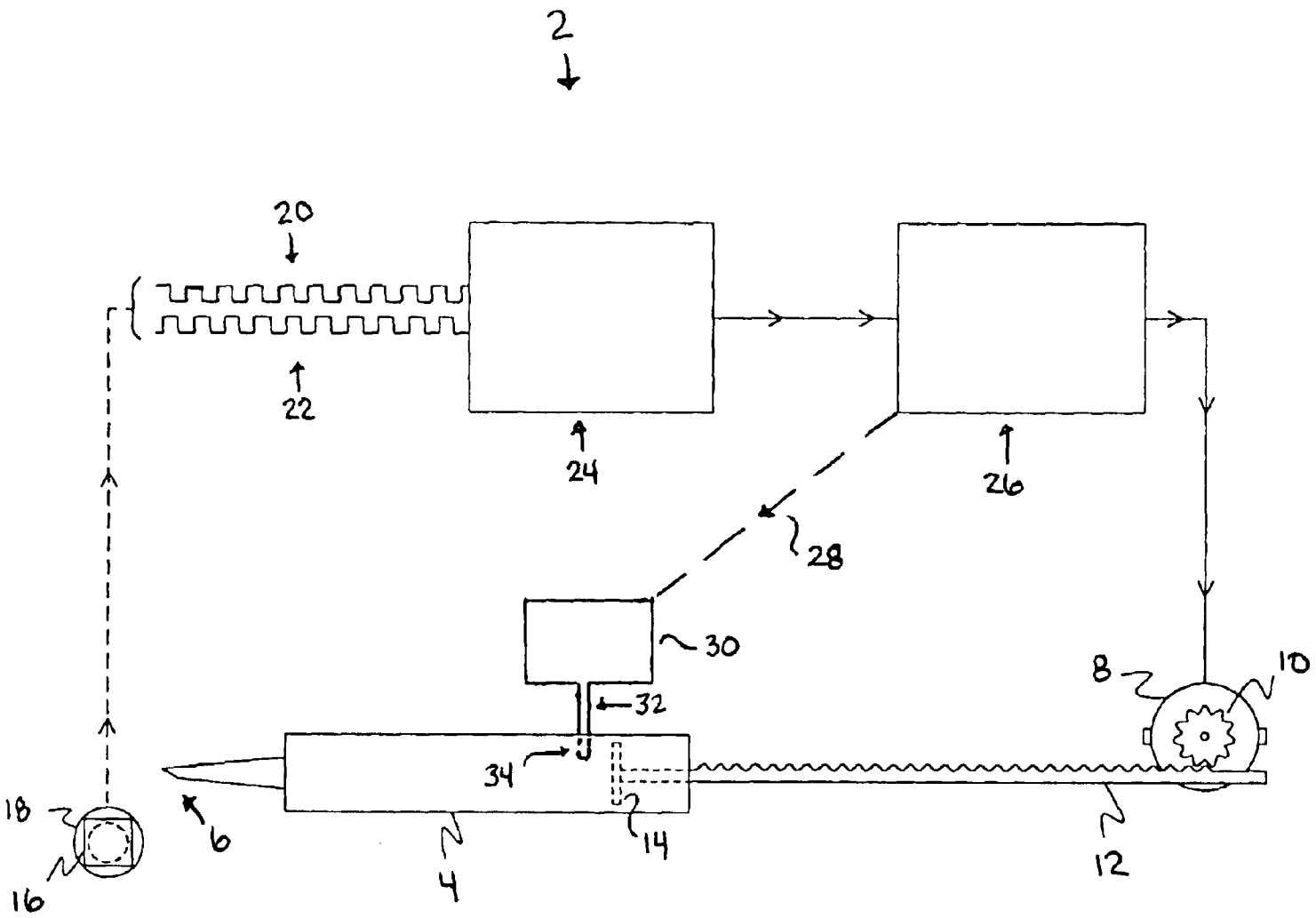
2
20
22
24
26
28
30
32
34
4
6
8
10
12
14
16
18

AUTOMATICALLY CONTROLLED FLOW APPLICATOR

BACKGROUND OF THE INVENTION

1. Field of the Invention

The present invention relates to the application of fluid or semifluid materials to surfaces. For example, the invention relates to the application of caulks, putty, grout, adhesives, pastes, sealants, weather-proofing and the like to various commercial, residential or industrial surfaces.

2. Background of the Art

The automated deposition of coating materials, such as adhesives, caulks, or sealants onto the surfaces of workpieces is commonly performed through the use of program control devices, such as robot-mounted fluid dispensing guns. The devices which support the guns are programmed to move the guns through a predetermined path with respect to a workpiece surface which corresponds to a desired pattern of application of the fluid onto the surface. In such devices, a control program establishes the tool speed, while a fluid dispensing control controls the discharge of fluid. The fluid is to be dispensed in accordance with an operator defined input signal which defines a desired physical characteristic of the applied fluid. For example, the input signal may represent bead size which defines the desired diameter of the bead to be applied to the workpiece. To achieve the desired bead size, the rate at which fluid is dispensed from the gun nozzle must be proportional to the relative velocity between the workpiece and the dispensing gun. Therefore, the rate at which fluid is dispensed through the gun nozzle must vary proportionally in real time in response to changes in the tool speed signal. The tool speed is defined as the linear or scalar speed at which the point of application of coating material on the workpiece surface moves with respect to the workpiece surface. The above fluid dispensing process is further subject to unpredictable changes in the flow characteristics of the fluid being dispensed. For example, changes in temperature, and other conditions will change in real time the flow characteristics of the fluid being dispensed; and those changes in flow characteristics will change the flow rate and hence the volume of fluid dispensed. In addition, there are flow non-linearities introduced by the shear effects of the fluid flow through the dispensing nozzle; and those flow non-linearities are dependent on the nozzle and nozzle wear. Therefore, it is desirable that the volume of fluid dispensed over a dispensing cycle be a controlled variable, and the total volume of fluid dispensed each dispensing cycle is measured.

As disclosed in the Baron, et al. U.S. Pat. No. 5,065,695 issued to the assignee of the present invention, the fluid dispensing control compensates the tool signal by a correction factor that is determined as a function of the changes in viscosity caused by shear effects of the fluid through the nozzle. As part of a setup calibration procedure, the flow of fluid through the nozzle is measured in response to different tool speed signal settings thereby producing a table data values which are stored in the fluid dispensing control memory. The stored data is used to calculate an interpolated linearization factor which is applied to the adjusted tool speed signal. The stored linearization factor is correlated to the relationship between flow rate and nozzle pressure as measured during the calibration process. However, the stored data remains fixed, and hence, the compensation is fixed over many dispensing cycles even though the relationship of flow rate to nozzle pressure may change. While the change is compensated for in a volume measurement control loop, the above system has the disadvantage of not being more quickly responsive to changes in the flow rate-nozzle pressure relationship.

In addition, the volume of fluid measured during one dispensing cycle is compared to a volume set point, and a material volume error signal is produced that represents changes in material viscosity that are caused by temperature changes or other dynamic conditions. The material volume error signal provides a compensation for changes in material viscosity that are caused by temperature changes or other dynamic conditions. The material volume error signal is produced from a proportional and integrating comparator. The volume of material that is dispensed is compared to a material weight setting, that is, a volume set point to produce a material volume error signal. Within the proportional and integrating comparator, a proportional term is set equal to approximately one-half the error signal; and the integral term is equal to the difference between the proportional term and the prior integral term. Consequently, the material volume error signal changes the pressure command signal gradually over several dispensing cycles to bring the volume of material that is being dispensed into conformity with the volume set point. For example, five or more dispensing cycles may be required to effect the volume compensation. While the above described system performs the necessary compensation, a disadvantage of the system is that several dispensing cycles are executed before the compensation is complete.

With the above system, the volume set point is determined by a preproduction experimental process in which a sample part is fixtured in the proximity of the fluid dispensing nozzle to simulate a production situation. The dispensing cycle is then executed, and the fluid dispensing nozzle and the workpiece are moved relative to each other such that the fluid is applied to the sample part in the desired pattern. Several dispensing cycles and parts may be required until the dispensed bead visually appears to be correct. When the correct bead is identified, the volume flow meter for that particular dispensing cycle is read; and the value of the volume flow meter is utilized as the material volume set point. Thereafter, the volume set point is conveyed to the production environment as part of the fluid dispensing program associated with that part.

U.S. Pat. No. 5,995,909 addresses these problems with a fluid dispensing control for controlling the dispensing of a fluid by a metering valve through a nozzle onto a workpiece. An initial value of a flow characteristic of the fluid is determined that is correlated to the relationship between the flow rate of the fluid and nozzle pressure. Desired nozzle pressure values are periodically determined by evaluating a model of flow rate of the fluid through nozzle in response to the initial value of the flow characteristic and a desired flow rate value. Thereafter, the control provides command signals to the metering valve as a function of the desired nozzle pressures. A new value of the flow characteristic is determined as a function of the measured volume of fluid dispensed during the dispensing cycle to the measured nozzle pressure. During a subsequent dispensing cycle, the control determines the desired nozzle pressures by evaluating the model of flow rate of the fluid through the nozzle as a function of the new value of the flow characteristic. The process of reevaluating the flow characteristic over successive dispensing cycles as a function of measured volumes of fluid dispensed and measured nozzle pressures, and using those updated values to reevaluate the model of flow rate of fluid through the nozzle, is repeated.

U.S. Pat. No. 5,857,589 describes a system for metering and dispensing single and plural component liquids and solids as described herein. The dispensing system has a microprocessor-based control system and volumetrically efficient non-reciprocating pumps which provide a very accurate control of component ratios, shot sizes, flow rates and dispense durations. The dispensing system maintains constant pressure between the output of the pump and the dispense head. The progressive cavity pump is formed from individual, interlocking pressure sections, each of which has a double helix bore. A rotor is inserted into the double helix bore with an interference fit. The dispense head has no dynamic fluid sealing surfaces and instead uses bellows as a sealing mechanism. The dispensing system includes a simple, easy to use calibration procedure and a weight scale. The system also has numerous feedback components for accurately controlling the pressure, flow rates, fluid levels and amounts of fluids dispensed.

U.S. Pat. No. 5,327,423 describes a timing circuit 10 that can be used to control the flow of fluid according to a specific time period that is allotted for each user includes a initialization circuit, a reset counter circuit, a flow time counter circuit, and a clock circuit. The timing circuit 10 accepts a DETECT* input signal, that indicates the presence of a user, and provides a DRIVE output signal that indicates when fluid shall be permitted to flow. The flow time counter circuit 38 is user configurable to provide a maximum flow time period while the DETECT* signal is active. The reset counter circuit ensures that each user is provided with his or her maximum flow time period by introducing a system reset time between consecutive users and by allowing a user to remove him or her self from being detected, thus placing the DETECT* signal in an inactive state and subsequently inactivating the DRIVE signal, for certain periods of time without forfeiting any of his or her allotted maximum flow time period. The initialization circuit provides the user with an initial controlled time period of fluid flow, if desired.

U.S. Pat. No. 5,319,568 describes a method and apparatus 10 are disclosed for applying a bead or strip of material upon an object, such that the bead has a desired cross-sectional area. Moreover, system 10 includes a source, controller, a dispensing apparatus, and a gun. In operation, controller, by controlling gun 14, ensures that a constant pressure of material is output from unit to gun, for a variety of material flow rates from unit. The material dispenser adapted to receive a pressurized stream of material, having a variable flow rate and to apply several separate portions of the received material to an object, the dispenser comprising: an applicator means, having a material reception orifice adapted to receive the stream of the material and to output the received material through an outlet orifice of variable size, for applying the separate portions of the received material to the surface of the object; and control means, coupled to the applicator means and under stored program control, for forcing the flow rate to be substantially equal to a first flow rate value and for measuring a first pressure of the stream of material when the stream is made to flow at a rate substantially equal to the first flow rate value and for selectively changing the flow rate of the stream of material to a second flow rate value and for varying the size of the material outlet orifice in order to ensure that the pressure of the stream of material, flowing at a rate substantially equal to the second flow rate value, is substantially equal to the first pressure whereby, each of the applied material portions are made to be substantially similar.

U.S. Pat. No. 5,263,608 describes a method for controlling the flow of adhesive, comprising the steps of providing a reservoir of adhesive connected to a dispensing nozzle by way of a flow line, measuring a flow of adhesive in the flow line in the range of from about 0.1 milliliters per minute to about 40 milliliters per minute and producing a first signal proportional to the measured flow, comparing the first signal to a predetermined set point, producing a second signal reflecting the difference between the first signal and the predetermined set point, sending the second signal to the dispensing nozzle, and adjusting the flow of adhesive to meet the predetermined set point.

U.S. Pat. No. 5,065,695 describes A fluid dispensing apparatus having a controller which operates to modify a tool speed signal from a robot and to generate a corrected signal to the dispenser nozzle flow controller which compensates for non-linear flow characteristics of fluids, such as non-Newtonian adhesive fluids, to maintain uniform bead size as the tool speed varies. The corrected tool speed signal is generated by computing the ideal flow for the tool speed signaled, comparing the computed flow with actual flow data stored in a memory using linear interpolation of data between the stored values, and generating a control signal modified in accordance with the comparison. The stored data is acquired by operation in a calibration mode wherein a series of standard signals is sent to the fluid controller while the actual flow at each signal level is measured and stored in a table. The method of operation corrects non-linear flow phenomena such as the shear-thinning effect.

U.S. Pat. Nos. 4,922,852 and 4,988,015 describes a method in which a fluid to be dispensed is delivered under pressure to a dispensing nozzle by way of an infinitely variable valve which is disposed in sufficiently close proximity to the nozzle that very little fluid pressure drop takes place in the region between the valve and the nozzle. A parameter correlated to the rate of flow of fluid discharged from the nozzle is sensed between the valve and the nozzle to generate a flow rate signal from which a control signal is derived by comparing the flow rate signal with a signal representing a desired rate of flow. Where the nozzle is to be moved relative a workpiece for dispensing fluid material thereon, the latter signal may be derived from a signal correlated to the speed of relative movement between the nozzle and the workpiece such as a tool speed signal from the robot.

U.S. Pat. No. 4,842,162 describes an apparatus and method for dispensing fluid materials wherein the fluid is discharged from a nozzle at a rate controlled by a metering valve having a seat and a stem moveable with respect to the seat to modulate the flow. A servo-actuator connected in a feedback control loop is used to position the valve stem with respect to its seat in accordance with a control signal. The control signal is derived in accordance with the difference between a driving signal representing a desired flow rate and the sum of a pair of feedback signals. One feedback signal represents the actual flow rate while the other feedback signal is correlated to both the relative velocity and position of the stem with respect to the seat. The position-dependent velocity signal is generated by a transducer comprising a magnet and a coil influencable by the field of the magnet as the magnet and coil move relative one another. For any given velocity, the magnitude of the position-dependent velocity signal is greater when the stem and seat are close together than when they are further apart so that as the valve closes, the amount of feedback increases.

U.S. Pat. No. 4,829,793 describes a fluid jet applicator for uniformly applying fluid from a fluid source to a substrate movable along a predetermined path, said fluid jet applicator comprising: an orifice plate having a linear array of orifices extending transversely to said predetermined path, said orifice plate including in the range of 50 to 150 orifices per inch; a manifold for receiving fluid from said fluid source and for distributing said fluid to said orifice plate; regulator means for regulating the pressure of the fluid fed to said orifice plate; and control means coupled to said regulator means and responsive to the speed of said substrate and data relating to tee characteristics of the substrate to control the uniform application of fluid to said substrate by regulating the pressure of the fluid fed to said orifice plate. In the exemplary embodiment of FIG. 1, a tachometer 20 is mechanically coupled to substrate 14. For example, one of the driven rollers of a transport device (not shown) used to cause substrate motion (or merely a follower wheel or the like) may drive the tachometer 20. In the exemplary embodiment, the tachometer 20 may comprise a Litton brand shaft encoder Model No. 74BI1OOO-1 and may be driven by a 3.125 inch diameter tachometer wheel so as to produce one signal pulse at its output for every 0.010 inch of substrate motion in the longitudinal or machine direction. It will be appreciated that such signals will also occur at regular time intervals provided that the substrate velocity remains at a constant value. Accordingly, if a substrate is always moved at an approximately constant value, then a time driven clock or the like possibly may be substituted for the tachometer 20 as will be appreciated by those in the art. The tachometer 20 is coupled via line 42 to microprocessor controller 40. Microprocessor controller 40, which, by way of example only, may be an Intel 8080 is coupled to a read only memory (ROM) 50 and a data entry keyboard/display device 52. Microprocessor controller 40, in a manner which will be explained in detail below in conjunction with FIG. 3, monitors the fluid jet applicator's operation and controls fluid flow by regulating the orifice fluid pressure. In this regard, upon sensing the tachometer output on line 42 and the current fluid pressure via line 31, the motorized restrictor valve 27 is controlled via line 46 to drive the fluid to the orifice array at, for example, an increased pressure. The fabric substrate is thereafter controlled by a fabric drive system (not shown) to move at a faster rate while maintaining the same add-on level to maintain uniform fabric coverage. Thus, the controller 40 controls the fluid pressure such that as the substrate speed is increased (as sensed by tachometer 20), the fluid pressure will be increased so that uniform fabric coverage will result. The fluid pressure must be continuously adjusted via signals from controller 40 via line 46 as the speed of the line changes.

Each of these disclosures relates to the control of flow of fluids from applicators, and many are directed towards the performance of automated devices where there are extensive electronic and memory capabilities attached to the device. It is desirable that flow control technology be available on manually operated devices. Although the above references are not descriptive of the present invention, they are incorporated herein by reference for their general teachings of fluid and pressure control in applicators, electronic circuitry, flow control elements, materials that can be applied and other technical features that can be incorporated into the present invention.

SUMMARY OF THE INVENTION

The present invention relates to the use of manually operated flow applicators, especially caulking, putty, masonry, grout, spackling and other pasty or fluid materials through a fluid dispensing nozzle or tube. The applicator varies the rate of application of a fluid material to a surface based upon a measurement of the relative speed of the applicator with regard to the surface to which the fluid is being applied. As the speed increases, the rate of flow of the fluid is increased, and as the speed decreases, the rate of flow of the fluid decreases automatically.

BRIEF DESCRIPTION OF THE FIGURES

FIG. 1 shows a schematic drawing of one embodiment of the fluid applicator of the present invention.

DETAILED DESCRIPTION OF THE INVENTION

The application of materials to surfaces, such as with caulking, grout, adhesive applications and the like, involves controlling the flow of the liquid (or semiliquid or pasty material) onto the surface from a container. As noted above, this is a serious issue in automated equipment, even with sophisticated applicators. It is no less a problem with hand-applied materials as with caulk guns and the like on industrial, residential or commercial sites. The most apparent effect of applying such materials at improper rates or volumes is the appearance of bumps, waves, wrinkles, and width variations in the applied material, and these deficiencies are unattractive and may actually diminish the performance of the applied material. Primarily, there are added costs for excess application of materials, added clean-up costs, and safety issues with improper application amounts of these materials.

The present invention provides a system and device and method for application of fluid materials with automatic variation or control of the application rate of the fluid material. The system 2 may, by way of a non-limiting example, comprise a tube 4 of fluid material (such as those described above and as known in the art) having an application end, here shown as a nozzle 6. Pressure inside of the tube 4 may be controlled by forces applied through either or both of a plunger 14 or a gas pressure applicator 30. The plunger 14 itself may be controlled by a stepper motor, pneumatic drive, magnetic drive or a linear gear arrangement or any other system that can drive the post 12 connected to the plunger 14. In the embodiment of FIG. 1, a wheel or motor 8 drives a gear 10 which drives the linear gear 12.

A speed measuring system such as the contact wheel 18 and signaling/encoding element 16 is provided to contact the surface (not shown) to be coated. The encoder 16 sends a signal that (by way of non-limiting example of one of a variety of comparison methods for the signal) is shown to be compared to two different phases 20 and 22 that define an acceptable range of speeds that correspond to the signals from the encoder 16. A constant pressure is maintained in the tube 4 when the signals from the encoder 16 are within the phase signals 20 and 22. The signals from the encoder are sent to a microprocessor 24 where they are read and evaluated, as by wired hardware or software or an algorithm in the hardware or software. The evaluation of the signals determines what if any changes in signals to the motor 8 are to be made. Signals from the microprocessor may be sent directly to the motor 8 or to a separate or integrated motor control element 26, which may be a chip, a board element on or related to the microprocessor 24 or the like. The motor control element 26 signals the motor 8 and/or the pressure control system 30 to control the pressure in the tube 4.

In a pressure control system 30, the signals 28 from the motor control element 26 may instruct the pressure control system to increase or decrease the pressure sent through connecting tube 32 into the interior 34 of the tube 4. As the speed detected by wheel 18 and signaled by encoder 16 is signaled through the system 2, both the motor 8 and/or the pressure control system 30 can increase and decrease pressure within the tube 4. The response of the system can be sufficiently rapid so that waves, wrinkles and misapplication of fluid material can be improved by the automatic system. As the system 2 moves relative to a surface and the wheel identifies the speed at which the system is moving relative to the system, the microprocessor varies the signals to the pressure control systems (the motor 8 or pressure system 30) to adjust the flow rate out of the nozzle 6.

The microprocessor may have input so that a standard flow rate, standard bead dimensions, standard solids volume (adjusting for drying) can be present or entered into the microprocessor. Another format would allow the user to test and preprogram the system by applying a test bead and providing a signal to the microprocessor when the bead dimensions (and hence the flow rate at the measured speed) are at the desired level. When the test has been entered and a speed/flow rate has been set as a standard, the microprocessor can then adjust the flow rate based on variations from the speed measured for the rotation of the wheel (or other speed measuring system).

The speed measuring system, such as by way of non-limiting example, the wheel 18 and encoder 16 may be rigidly fixed or flexibly fixed to the tube 4, may be attached by an extension element (e.g., a pole) to the tube 4 or when the applicator is held by a user over a moving work line, the wheel may be fixed with relation to the surface and only electronically connected the motor 8, pressure control 30 and eventually the tube 4.

One communication system between the speed measuring unit (which can be sonic, infrared, or other mechanical system besides the wheel/tachometer system shown in the figure) could be a bus connected to a user control microprocessor which includes a central processing unit "CPU", for example and Intel, Motorola etc. microprocessor, such as a 68000 microprocessor available from Motorola of Phoenix, Ariz., volatile and nonvolatile RAM storage, ROM storage, and bus connected to a bus interface. The user may have user control functions basically as an I/O processor and coordinates the communication of data to and from the user I/O devices (e.g., a panel on the processor, data input buttons or keyboard and to and from external devices generally located remote from the fluid dispensing tube. Since the general modes and cycles of operation are initiated either by inputs from the operator I/O devices or the external speed measuring devices, the user control may provide input signal states to a servo control which executes various tasks such as driving the motor 8 or the pressure system 30 in the fluid dispensing cycle. The operator I/O devices is used to initiate different modes of operation, for example, a set up mode, set up a speed, set up a bead size, adjust for varying viscosity and an operating mode. In the set up mode, the operator may use the I/O devices to enter information relating to the desired flow, for example, bead size, and scaling factors such as the flow meter encoder pulse count per revolution. In addition, the operator I/O devices may display information relating to the dispensing process, for example, alarm or error signals.

The user control may store various operating programs in ROM that command desired sequences of tasks or events depending on the desired current control operation and detected external conditions. The user control may provides commands within the fluid dispensing control that start and end a dispensing cycle, that turn ON and turn OFF the dispensing gun, etc. The user control provides other schedules of events depending on the then current operation of the fluid dispensing control.

The fluid dispensing control may further include a digital I/O which has a digital I/O interface that provides and receives digital signals to and from, respectively, external devices within the fluid dispensing system. A digital I/O interface may provide bits of I/O data. Input data typically includes beginning of part and end of part signals, a part identification word, a dispensing gun ON/OFF signal, etc. Input signals are received from the external devices that may or may not have their own respective digital I/O interface on one of the digital I/O lines connected to a respective input of the digital I/O interface. Those input signals are passed to the bus by a bus interface, and the user control receives the input signals from the bus through its bus interface. During its operation, the user control will detect different conditions and process states. Those process conditions include the values of measured process variables, for example, nozzle pressure, material temperature, and error conditions; and the user control will either provide some of those process conditions to the display within the operator I/O devices, or provide output digital signals representing those process conditions from the fluid dispensing control 2, or provide both. In the case of providing a digital output signal, the CPU within the user control will transfer the digital output signal to the bus interface, across the bus, to the bus interface and to a respective output of the digital I/O interface. That digital output signal is then available on a respective one of the digital I/O lines and is read or received by the external devices within the system.

The fluid dispensing control any further includes a servo control operating in conjunction with the supervisor control. Data is exchanged between the servo control and the supervisor control through a dual port RAM. The dual port RAM may be preferably a bit shared memory device, e.g., such as one commercially available from Cypress of San Jose, Calif. Within the servo control, a microprocessor may execute programs or routines stored in ROM. In executing those programs, the microprocessor utilizes the RAM, floating point math coprocessor, and an interconnecting 16 bit parallel bus. The microprocessor may preferably be a model 68HC16 microprocessor, an Intel microprocessor or a Motorola microprocessor and the coprocessor is also preferably one of the 68000 family of processors commercially available from Motorola of Phoenix, Ariz. or an equivalent or superior coprocessor. Analog data is received from various components within the fluid dispensing system and may be converted to corresponding digital signals by an A/D converter which preferably is a 10 bit A/D converter available on the microprocessor.

Upon power being applied to the microprocessor and other devices within the servo control, a power ON or reset program or routine stored in ROM is executed. The power on routine operation may first execute initialization and self test subroutines. Those subroutines can run standard tests of the hardware within the servo control. The remainder of the power ON routine is a real time task scheduler which preferably responds to a fast, e.g., 2 millisecond (ms), clock. The power ON routine a first initializes the task scheduler. Initialization includes resetting the counters and/or timers which are included within the scheduler and, if necessary, priorities of the scheduled tasks are rearranged.

An optional way of describing various aspects of the present invention also includes a system for the manual application of a fluid material in a linear pattern to a surface from a container holding the fluid comprising: the container holding a fluid, the container having an application end from which fluid is applied to the surface at a volume flow rate that provides a (volume of fluid/linear distance) of the linear pattern, a controllable pressure system that causes pressure in the container, wherein application of higher pressure causes increased flow of fluid from the container and reduction of pressure causes reduced flow of fluid from the container, a control that can adjust the controllable pressure and can set the controllable pressure in the container at a constant level, and a microprocessor that receives signals regarding conditions in the environment of the system and determines if the controllable pressure is at a predetermined target level with respect to a target speed, the microprocessor adjusting the controllable pressure system in response to sensed changes in conditions that alter the volume of fluid/liner distance. By manual application it is meant that the device is to be supported and guided by hands of a human. The fluid, as previously indicated, does not have to be a Newtonian fluid, nor a pure fluid, but can be thixotropic (with data indicating the effects of pressure on the flow rate), suspensions, dispersions, blends, and the like, especially pasty blends such as adhesives, caulks, grouts, and the like. The conditions may be selected from the group consisting of ambient temperature, fluid temperature, fluid viscosity, container angle, power variations in the pressure control system, and pressure increases at the application end. The container holding a fluid and the setting of controls can be performed by hand by a user, especially where the user moves the container along the linear pattern. A speed indicator may measure relative speed of movement of the application end to a surface and the speed indicator comprises a wheel that rotates along the linear path on the surface.

A method of the present invention may also comprise applying a fluid material to a surface from a container, applying pressure to the fluid material to deliver a bead of material to a surface, observing flow rate of a bead delivered from the container at a relative speed of movement between an application end of the container and the surface, and setting a pressure control on a pressure control system that controls the pressure on the fluid material to provide a bead of desired size at the relative speed. A sensor may be present that provides data to a microprocessor that directs the pressure control system, the sensor measuring conditions that can alter bead size applied at the speed, the microprocessor directing the pressure control system to alter pressure in response to data indicating that bead size will alter because of sensed changing conditions. The conditions sensed may be, by way of non-limiting examples, be selected from the group consisting of ambient temperature, fluid temperature, fluid viscosity, container angle, power variations in the pressure control system, and pressure increases at the application end, or preferably a change in the relative speed between the application end and the surface.

The objects of the invention may be achieved by variations in the materials, hardware, software and designs that are within the skills of the ordinary artisan without deviating from the practice of the generic invention taught herein. Such alternatives (such as size of memory, speed measuring systems, fluids applied, and the like) are within the skill of the artisan in the design of the systems of the present invention and still be within the intended teachings of the generic invention.

What is claimed:

1. A system for the user directed manual application of a fluid material in a linear pattern to a surface from a container holding the fluid comprising:

the container holding a fluid, the container having an application end from which fluid is applied to the surface at a volume flow rate that provides a volume/linear distance of the linear pattern, a controllable pressure system that causes pressure in the container, wherein application of higher pressure causes increased flow of fluid from the container and reduction of pressure causes reduced flow of fluid from the container, a speed indicator that provides a signal of the relative speed between the application end and the surface, a microprocessor that reads the signal and determines if the controllable pressure is at a predetermined target level with respect to the relative speed, the microprocessor adjusting the controllable pressure system to attempt to maintain a standard volume of liquid per linear distance of the linear pattern;

wherein the container holding a fluid is held by hand by a user.

2. The system of claim 1 wherein the user moves the container along the linear pattern.

3. The system of claim 1 wherein the speed indicator comprises a wheel that rotates along the linear path on the surface.

4. The system of claim 1 wherein a bead dimension, bead volume, or liquid flow rate/linear distance is provided in memory in the microprocessor as a measure of the standard volume to be maintained.

5. The system of claim 1 wherein the microprocessor can be accessed to provide a standard volume to be maintained by applying a bead of liquid and manual input to the microprocessor can indicate when the bead is an acceptable size.

6. The system of claim 1 wherein the pressure is adjusted by motivation of a plunger in the container.

7. The system of claim 1 wherein the pressure is maintained by injecting or withdrawing fluid in the container.

8. The system of claim 1 wherein determining if the controllable pressure is at a predetermined target level with respect to the relative speed is effected by comparing a measured speed and measured liquid volume flow rate to at least two values, one value representing a high tolerance level for liquid volume/speed of application and a second value representing a low tolerance limit for liquid volume/speed of application.

9. A system manually held by an operator and moved along a surface on which a fluid material is to be applied for the manual application of the fluid material in a linear pattern to a surface from a container holding the fluid comprising:

the container holding a fluid, the container having an application end from which fluid is applied to the surface at a volume flow rate that provides a (volume of fluid/linear distance) of the linear pattern, a controllable pressure system that causes pressure in the container, wherein application of higher pressure causes increased flow of fluid from the container and reduction of pressure causes reduced flow of fluid from the container, a control that can adjust the controllable pressure and can set the controllable pressure in the container at a constant level, and a microprocessor that receives signals regarding conditions in the environment of the system and determines if the controllable pressure is at a predetermined target level with respect to a target speed, the microprocessor adjusting the controllable pressure system in response to sensed changes in conditions that alter the volume of fluid/liner distance.

10. The system of claim 9 wherein said conditions are selected from the group consisting of ambient temperature, fluid temperature, fluid viscosity, container angle, and power variations in the pressure control system.

11. The system of claim 9 wherein the container holding a fluid is held by hand by a user as the user moves the applicator.

12. The system of claim 11 wherein the user moves the container along the linear pattern.

13. The system of claim 11 wherein a speed indicator measures relative speed of movement of the application end to a surface and the speed indicator comprises a wheel that rotates along the linear path on the surface.

14. The system of claim 8 wherein the application end comprises a tube of fluid material having an nozzle, wherein pressure inside the tube is controlled by forces applied through either or both of a plunger and a gas pressure applicator.

15. The system of claim 14 wherein the plunger is controlled by a control selected from the group consisting of stepper motor, pneumatic drive, magnetic drive and a linear gear arrangment.

* * * * *